US010822918B2

(12) United States Patent
Flores Perez et al.

(10) Patent No.: US 10,822,918 B2
(45) Date of Patent: Nov. 3, 2020

(54) SAND CONTROL SCREENS FOR HYDRAULIC FRACTURE AND METHOD

(71) Applicants: Juan Carlos Flores Perez, The Woodlands, TX (US); Vitaly Y. Shkred, Moscow (RU)

(72) Inventors: Juan Carlos Flores Perez, The Woodlands, TX (US); Vitaly Y. Shkred, Moscow (RU)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 182 days.

(21) Appl. No.: 15/927,805

(22) Filed: Mar. 21, 2018

(65) Prior Publication Data

US 2019/0292877 A1 Sep. 26, 2019

(51) Int. Cl.
*E21B 34/06* (2006.01)
*E21B 43/08* (2006.01)

(52) U.S. Cl.
CPC ..... *E21B 34/063* (2013.01); *E21B 43/08* (2013.01); *E21B 43/082* (2013.01); *E21B 43/088* (2013.01)

(58) Field of Classification Search
CPC .... E21B 34/063; E21B 43/082; E21B 43/088; E21B 43/26; E21B 43/08; E21B 43/086; E21B 17/10
See application file for complete search history.

(56) References Cited

U.S. PATENT DOCUMENTS

| | | | | |
|---|---|---|---|---|
| 3,390,724 | A * | 7/1968 | Caldwell | E21B 34/063 166/100 |
| 5,355,956 | A * | 10/1994 | Restarick | E21B 43/11 166/296 |
| 7,451,815 | B2 | 11/2008 | Hailey, Jr. | |
| 7,909,088 | B2 | 3/2011 | O'Malley et al. | |
| 9,512,694 | B2 | 12/2016 | Lopzez et al. | |
| 2013/0118729 | A1* | 5/2013 | Greci | E21B 34/08 166/117 |
| 2014/0151052 | A1* | 6/2014 | Themig | E21B 17/18 166/308.1 |
| 2015/0096762 | A1* | 4/2015 | Al-Ajmi | E21B 34/14 166/373 |
| 2015/0330191 | A1 | 11/2015 | Hodlerman et al. | |
| 2016/0230509 | A1 | 8/2016 | Lopez et al. | |
| 2016/0326851 | A1* | 11/2016 | Flores Perez | E21B 43/26 |
| 2018/0347330 | A1* | 12/2018 | Facca | E21B 43/26 |

OTHER PUBLICATIONS

Notification of Transmittal of the International Search Report and the Written Opinion of the International Searching Authority, or the Declaration; PCT/US2019/021343; dated Jun. 19, 2019; total 9 pages.

* cited by examiner

*Primary Examiner* — Michael R Wills, III
(74) *Attorney, Agent, or Firm* — Cantor Colburn LLP

(57) ABSTRACT

A sand control screen system including a housing having an inner diameter, a filtration configuration disposed about the housing, a filtered volume between the housing and the filtration configuration, and a breach feature segregating the filtered volume from the inner diameter.

10 Claims, 4 Drawing Sheets

SAND CONTROL SCREENS FOR HYDRAULIC FRACTURE AND METHOD

BACKGROUND

In the resource recovery industry there is often a need to produce fluids from particulate laden formation reservoirs. In order to avoid excessive erosion of recovery components it is often desirable to filter particulates before they enter the recovery equipment. Sand screens are commonly used for this purpose and are well known to the industry. With the advent of hydraulic fracturing operations to increase recovery from formations sand screens of the art can be significantly damaged by the high pressure high flow rate fluids designed and applied to create fractures in the target formation. Damage to the screens in this context results in earlier screen degradation and earlier particulate production thereby increasing erosion and increasing costs of recovery. The art then will well receive alternatives that avoid the above discussed issue.

SUMMARY

A sand control screen system including a housing having an inner diameter, a filtration configuration disposed about the housing, a filtered volume between the housing and the filtration configuration, and a breach feature segregating the filtered volume from the inner diameter.

A method for fracturing including installing a screen system as claimed as in any prior embodiment in a borehole, pumping fracturing fluid into the borehole, and breaching the breach feature.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
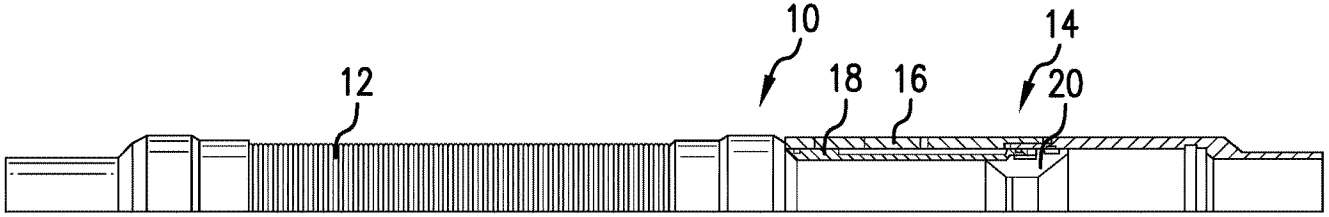
FIG. 1A is a schematic representation of a sand screen with a frac port attached thereto that serves as a generic representation of the outside of each embodiment disclosed herein.

Referring to FIG. 1A a more generic view of a sand screen system 10 is illustrated. FIG. 1A is common to all of the embodiments disclosed herein since the exterior of each of the embodiment appears identical while the internal features differ. The screen 12 (illustrated schematically to include various commercially available filtration media and configurations that screen out particulate material such as screen jacket structure, a wire wrap structure, a bead screen structure, a shape memory foam structure, etc.) from an external view is quite similar to those of the prior art and will be recognized by those of ordinary skill in the art. Adjacent the screen 12 is illustrated a cross sectional view of a frac port sub 14 having a fracture port 16, a sleeve 18 and a seat 20. The system as claimed herein requires a way to deliver fracture fluid to the formation and a way to close that pathway when production is to occur. Configurations that do this are widespread and well known and do not require explicit teachings. Many of them however, are prone to damage the screen that is a part of their related systems. Disclosed herein is a screen that is not damaged by fracture fluid and hence benefits the art for inclusion as a screen component of any sand screen system 10.

Figure 1B:
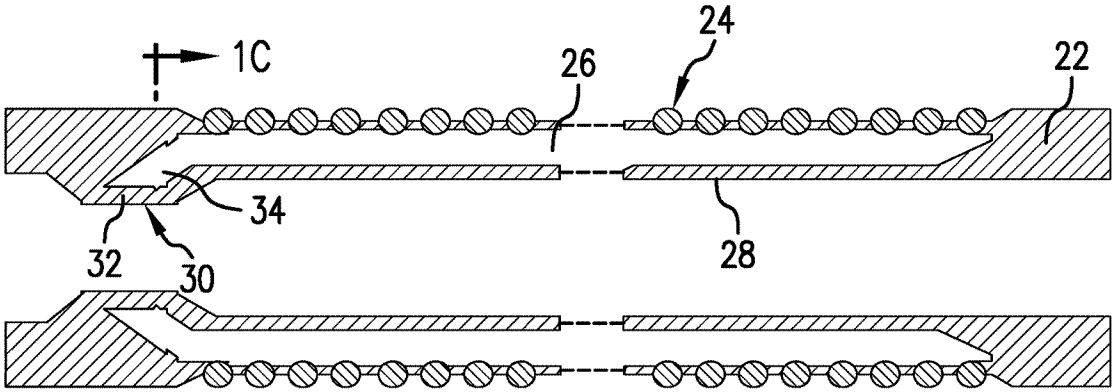
FIG. 1B is a schematic cross sectional view of the embodiment of FIG. 1A illustrating a first condition thereof.

Referring to FIG. 1B, a cross section of a first embodiment is illustrated. The embodiment includes a housing 22 with a filtration configuration 24. Filtration configuration 24 may be a screen jacket structure, a wire wrap structure, a bead screen structure, a shape memory foam structure, etc. Also illustrated is a filtered volume 26 radially inwardly of the filtration configuration 24. The filtered volume 26 may be configured as a single annular area or may be configured a multiple part annular segments that together form an annulus or the filtered volume 26 may simply be part annular. The filtered volume 26 is in fluid communication with environment radially outwardly of the filtration configuration 24 but not fluidly communicative with flow volume radially inwardly of the housing 22, or more colloquially, the inside diameter (ID) 28 of the housing 22. As will be appreciated, fracture fluid is delivered to a target environment through the ID of a tubing string of which the sand screen system 10 is a part. Accordingly, the ID of the sand screen system 10 experiences high pressure and/or high flow rates for fracturing fluid therein. If the filtration configuration 24 is fluidly connected to this volume, the filtration configuration 24 would be likely to experience damage. As taught herein, then, the area 26 is cordoned off from the ID fluid by a breach feature 30.

Referring to FIG. 1B, breach feature 30 is located to be radially inwardly positioned relative to an intended final inside diameter 28 of the housing 22. That is, when conditions for burst and collapse resistance are determined and a thickness of the base pipe material of housing 22 is known then the breach feature 30 will extend radially inwardly thereof. This can clearly be seen in FIG. 1B. The breach feature 30 in the FIG. 1 embodiment includes both an enclosure portion 32 and a hollow 34, the hollow being in fluid communication with the filtered volume 26. During initial operations, the feature 30 ensures that no fluid properties from the ID of the housing 22 will be borne by the filtration configuration 24.

Figure 1D:
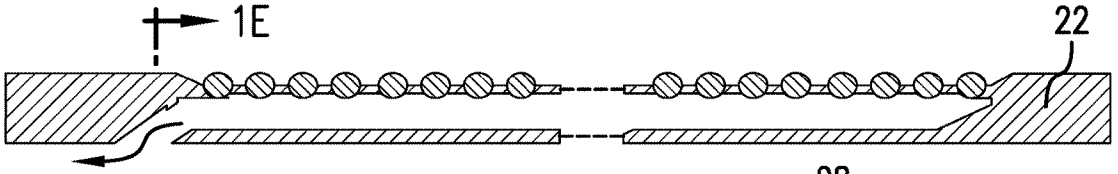
FIG. 1D is the view of FIG. 1B but in a second condition thereof.
Figure 1D:
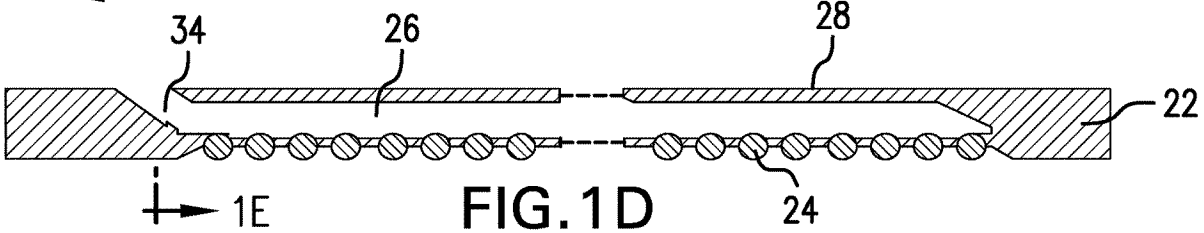
Figure 1C:
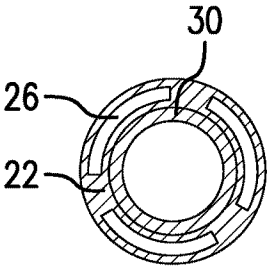
FIG. 1C is a section view of the embodiment of FIG. 1A in the first condition.
Figure 1E:
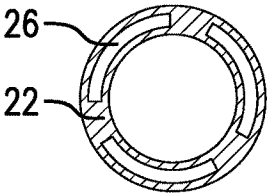
FIG. 1E is a section view of the embodiment of FIG. 1A in the second condition.

Referring to FIG. 1D, the system 10 is illustrated after a milling operation removing a portion of the feature 30. Comparing FIGS. 1B and 1D will make the removal of material plain. In addition, the removal of material can also be easily appreciated by comparing FIGS. 1C and 1E where it is evident that material has been removed which communicates hollow 34 with the ID 28 of housing 22. At this point production is possible through the filtration configuration 24 and it is presumed that the port through which fracturing was undertaken has been closed. It is noted that many systems that open and close fracturing ports also require a milling operation to remove the ball seats used for the operation. In such situations, the milling required to communicate hollow 34 with the ID 28 is not even an additional run and yet provides complete protection for the filtration configuration during the fracturing operation and complete utility of the filtration configuration thereafter simply by running the mill.

Figure 2A:
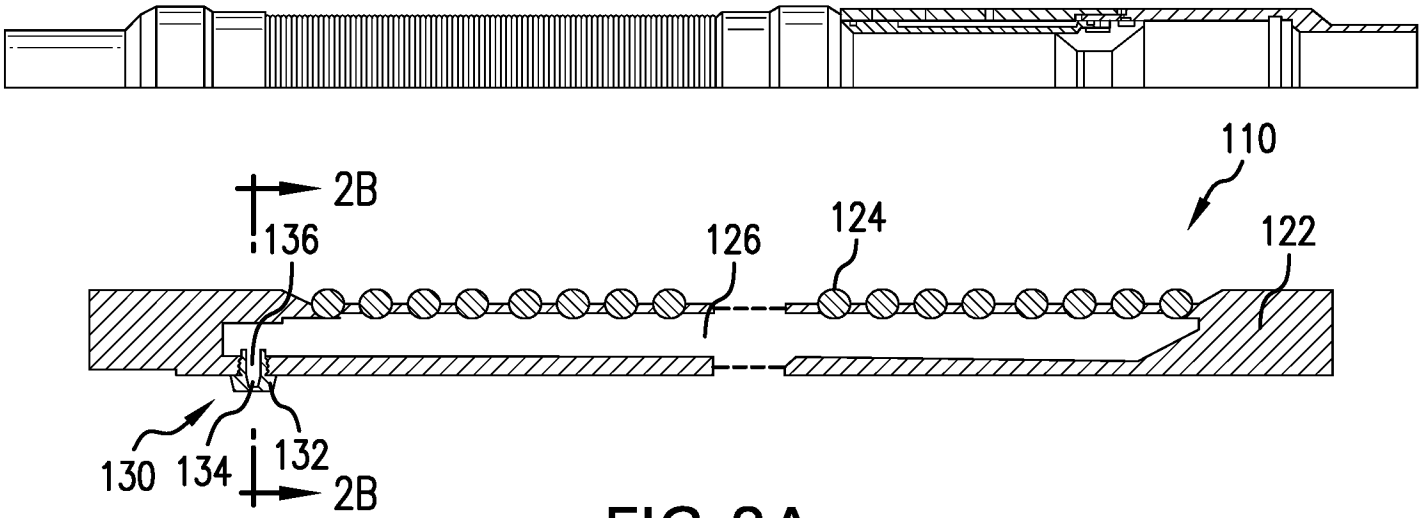
FIG. 2A is a cross sectional representation of another embodiment in a first condition.
Figure 2C:
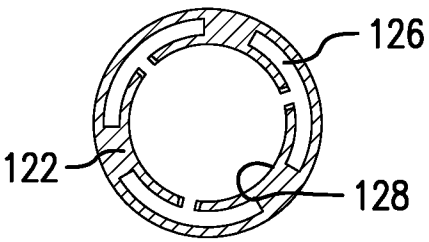
FIG. 2C is a section view of the embodiment of FIG. 2A in a second condition.
Figure 2D:
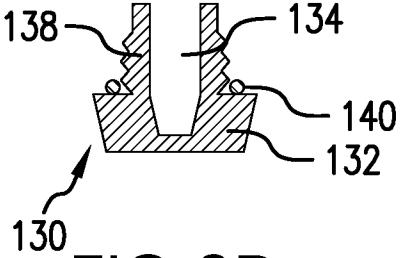
FIG. 2D is a cross sectional illustration of a plug of embodiment 2A.
Figure 2B:
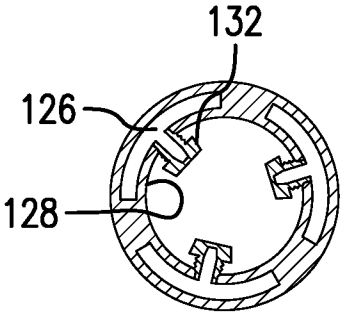
FIG. 2B is a section view of FIG. 2A in the first condition.

Referring to FIG. 2A, an alternate embodiment is illustrated. 100 series numerals are used to denote similar items. Hence, the system 110 includes a housing 122, a filtration configuration 124, a filtered volume 126, an ID 128 and a breach feature 130. The breach feature 130 includes an enclosure portion 132 and a hollow 134. It will be evident that the embodiment is similar to the foregoing one other than the geometry and constitution of the feature 130. In this case, the feature 130 is a cap-like structure that is configured to be affixed to or in a hole 136 in the housing 122. In one iteration of feature 130, a thread 138 is provided to engage a like profile (not shown) in the hole 136. Also in some embodiments a seal 140 may be added, that seal being rubber, metal, etc. The breach feature 130 acts similarly to the breach feature 30 to prevent properties of ID fluid from acting on the filtration configuration 124. After a milling operation the system 110 will have the section view illustrated in FIG. 2C. It will be appreciated that the enclosure portion 132 of feature 130 has been removed thereby communicating the ID 128 to the filtered volume 126 through the hollow 134. In other respects the system 110 is the same as that of system 10.

Figure 3A:
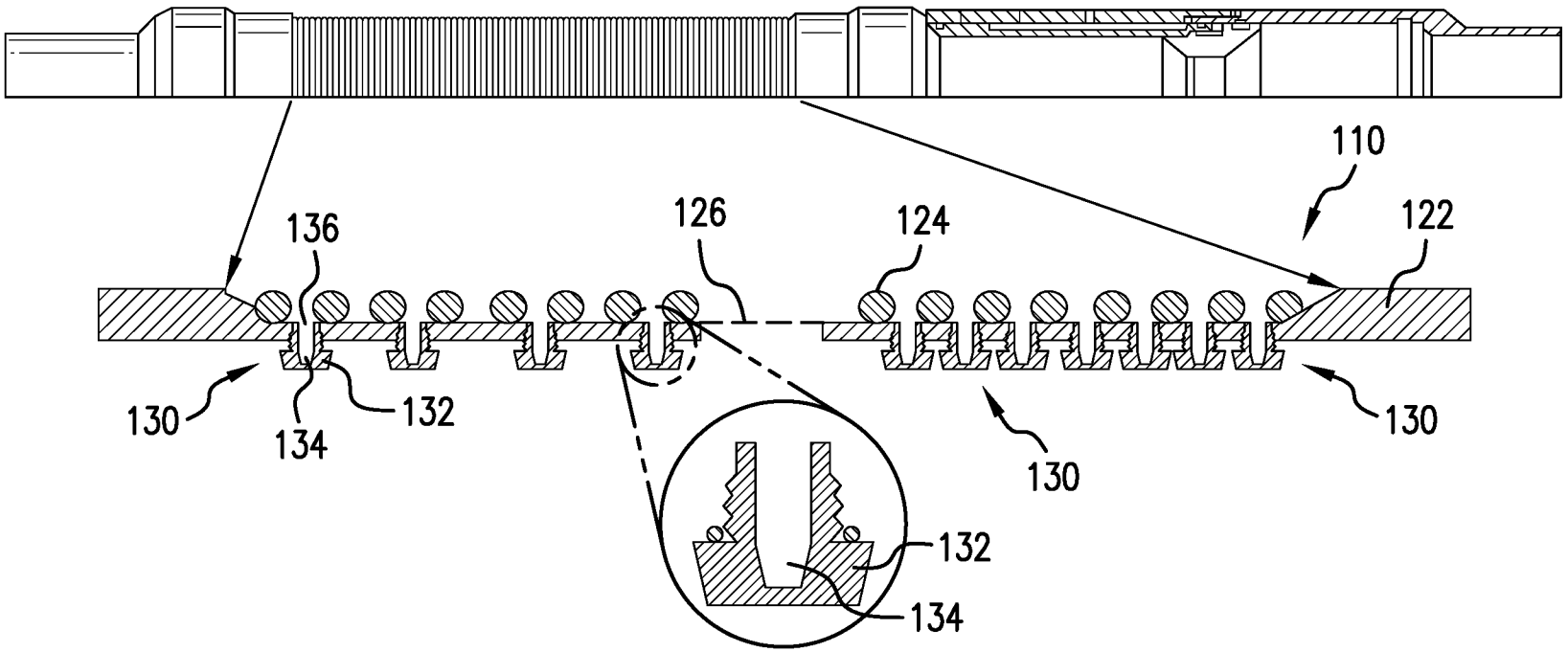
FIG. 3A is a cross sectional embodiment of another alternate embodiment.

Referring to FIG. 3A, a similar embodiment to that illustrated in Figure group 2 is disclosed. The same features 130 are used but there are a plurality of them along the longitudinal length of each filtered volume 126. In other respects the embodiment is identical to that of Figure group 2.

It is to be understood that the features 30 and 130 may be configured from persistent materials such as metal stable composites etc. that will resist environmental forces and must be actively removed by such as milling. The features 30 and 130, or similar constructions having the same operational parameters of including an enclosure portion and a hollow portion and whose defeat will cause fluid communication between fluid around the screen and fluid within the tubular through the hollow of the feature may also be constructed of a degradable, dissolvable, disintegratable material or a material otherwise configured to go away without some mechanical intervention such as milling (in order to avoid the milling requirement) to open the fluid communication interrupted by the feature. The term "degradable" will be used hereinafter for all of these properties for simplicity in communication. One suitable material for such use would be INtallic dissolvable material available from Baker Hughes, a GE company, Houston Tex.

In addition, it is also to be understood that in some instances, it may be desirable to provide a flow control device in the fluid communication pathway between the area 26/126 and the ID 28/128.

Figure 4A:
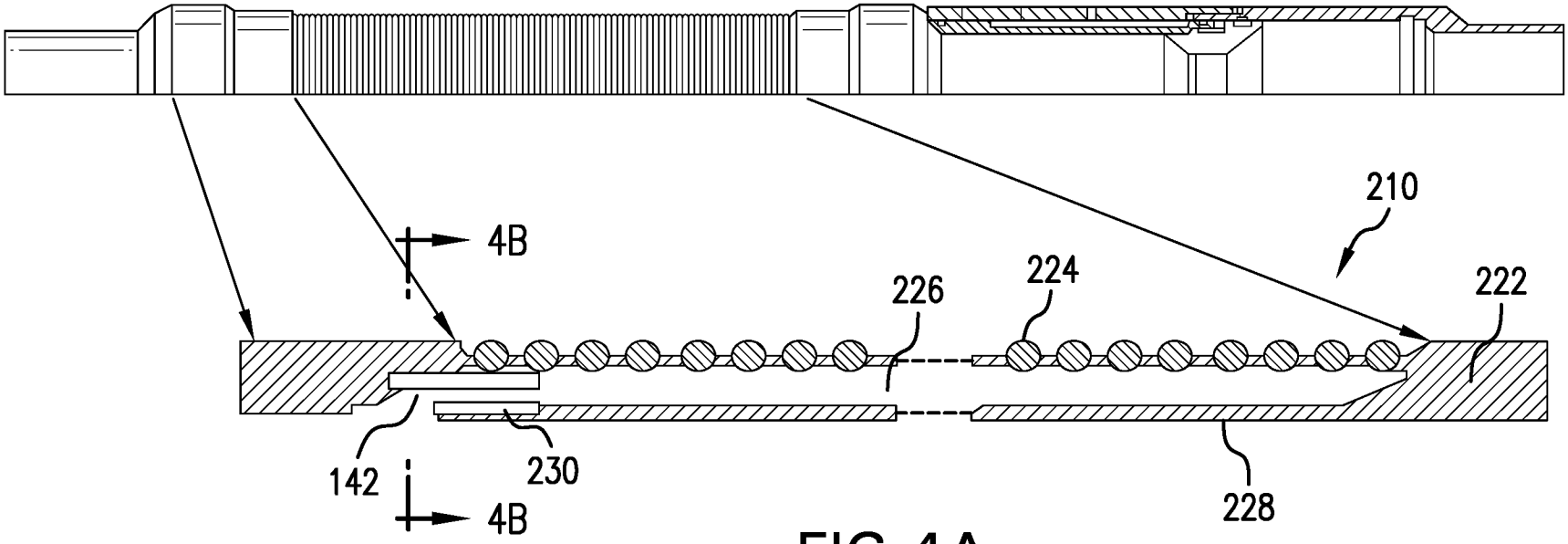
FIG. 4A is a cross sectional view of another alternate embodiment.
Figure 4B:
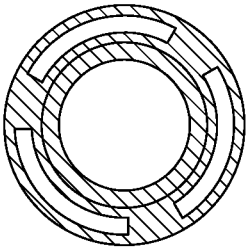

In another alternate embodiment of the system 210, referring to FIG. 4A, a feature 230 is provided among the now familiar components of the housing 222, filtration configuration 224, and filtered volume 226. While the features 30 and 130 above, whether being millable material or dissolvable material are ultimately removed to communicate the ID fluid and the filtered volume 26/126 fluid, the feature 230 need not be removed by mechanical or chemical means but rather is configured of a shape memory material. The material is configured to have a lower temperature shape that occludes a passageway 142 otherwise communicating the ID 228 with the filtered volume 226. Upon reaching a relatively higher temperature at which temperature it is configured to transfigure to another shape, the passageway 142 becomes open. The temperature of fracture fluid being pumped from surface is substantially lower than ambient downhole temperature where systems like those disclosed herein are to be employed. Accordingly, the feature 230 will remain closed which the otherwise damaging high pressure high flow rate fracturing fluid is pumped such that the filtration configuration 224 is protected from properties thereof. Once the fracturing fluid stops flowing and ambient temperature recovers to "normal" for the region where the system is deployed, the feature 230 will naturally and automatically open thereby communicating the filtered volume 226 and the ID 228 for production.

Set forth below are some embodiments of the foregoing disclosure:

Embodiment 1

A sand control screen system including a housing having an inner diameter, a filtration configuration disposed about the housing, a filtered volume between the housing and the filtration configuration, and a breach feature segregating the filtered volume from the inner diameter.

Embodiment 2

The system as in any prior embodiment wherein the breach feature is a persistent material.

Embodiment 3

The system in any prior embodiment wherein the breach feature is a degradable material.

Embodiment 4

The system as in any prior embodiment wherein the breach feature is a portion of the housing.

Embodiment 5

The system as in any prior embodiment wherein the breach feature wherein the breach feature extends radially inwardly of a balance of the housing.

Embodiment 6

The system as in any prior embodiment wherein the breach feature includes a hollow in fluid communication with the filtered volume.

Embodiment 7

The system as in any prior embodiment wherein the breach feature includes an enclosure portion.

Embodiment 8

The system as in any prior embodiment wherein the breach feature is a cap-like structure.

Embodiment 9

The system as in any prior embodiment wherein the breach feature includes threads.

Embodiment 10

The system as in any prior embodiment wherein the breach feature includes a seal.

Embodiment 11

The system as in any prior embodiment wherein the breach feature wherein the breach feature is a plurality of breach features arranged about the housing.

Embodiment 12

The system as in any prior embodiment wherein the breach feature wherein the breach feature is a plurality of breach features arranged longitudinally along the housing.

Embodiment 13

The system as in any prior embodiment wherein the system further includes an inflow control device disposed between the filtered volume and the ID.

Embodiment 14

The system as in any prior embodiment wherein the breach feature is a shape memory material.

Embodiment 15

The system as in any prior embodiment wherein the shape memory material is in a closed configuration at a temperature associated with pumping fracture fluid and in an open configuration when at an ambient temperature higher than the fracture fluid temperature.

Embodiment 16

The system as in any prior embodiment wherein the filtration configuration is at least one of a screen jacket structure, a wire wrap structure, a bead screen structure, and a shape memory foam structure.

Embodiment 17

A method for fracturing including installing a screen system as claimed as in any prior embodiment in a borehole, pumping fracturing fluid into the borehole, and breaching the breach feature.

Embodiment 18

The method as in any prior embodiment wherein the breaching is milling.

Embodiment 19

The method as in any prior embodiment wherein the breaching is degrading.

Embodiment 20

The method as in any prior embodiment wherein the breaching is changing a temperature at the beach feature.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A sand control screen system comprising: a single-piece unitary housing having both an inner diameter (ID) and an integral breach feature presenting an innermost dimension smaller than the housing inner diameter; a filtration configuration disposed about the housing; a filtered, at least part annular volume between the housing and the filtration configuration; and the breach feature segregating the filtered volume from the inner diameter.

2. The system as claimed in claim 1 wherein the breach feature is a persistent material.

3. The system as claimed in claim 1 wherein the breach feature includes a hollow in fluid communication with the filtered volume.

4. The system as claimed in claim 1 wherein the breach feature includes an enclosure portion.

5. The system as claimed in claim 1 wherein the breach feature is a plurality of breach features arranged about the housing.

6. The system as claimed in claim 1 wherein the breach feature is a plurality of breach features arranged longitudinally along the housing.

7. The system as claimed in claim 1 wherein the system further includes an inflow control device disposed between the filtered volume and the ID.

8. The system as claimed in claim 1 wherein the filtration configuration is at least one of a screen jacket structure, a wire wrap structure, a bead screen structure, and a shape memory foam structure.

9. Installing a screen system as claimed in claim 1 in a borehole;

pumping fracturing fluid into the borehole; and breaching the breach feature.

10. The method as claimed in claim 9 wherein the breaching is milling.

* * * * *